US005215177A

United States Patent [19]

Johnson et al.

[11] Patent Number: 5,215,177

[45] Date of Patent: Jun. 1, 1993

[54] ESCALATOR SKIRT AND DECK PANEL QUICK RELEASE FASTENER ASSEMBLY

[75] Inventors: Gerald E. Johnson, Farmington; Frank M. Sansevero, Glastonbury, both of Conn.

[73] Assignee: Otis Elevator Company, Farmington, Conn.

[21] Appl. No.: 941,471

[22] Filed: Sep. 8, 1992

[51] Int. Cl.[5] ..... B66B 23/22

[52] U.S. Cl. ..... 198/335

[58] Field of Search ..... 198/335, 337

[56] References Cited

U.S. PATENT DOCUMENTS

| | | | |
|---|---|---|---|
| 4,159,758 | 7/1979 | Courson | 198/335 |
| 4,646,907 | 3/1987 | Streibig et al. | 198/335 |
| 4,819,781 | 4/1989 | Saito et al. | 198/335 |
| 4,889,222 | 12/1989 | Kanamori | 198/335 |
| 5,029,690 | 7/1991 | Nguyen et al. | 198/335 |

*Primary Examiner*—Joseph E. Valenza

*Attorney, Agent, or Firm*—William W. Jones

[57] ABSTRACT

The skirt and deck panels of an escalator or moving walkway are edge-lapped, and are detachably secured together by a plurality of screws and quarter turn locking nuts. The deck panels are provided with a series of round, spaced-apart screw holes, and the skirt panels are provided with a plurality of elongated slots which allow flexible alignment with the screw holes. Position stops are mounted on the ends of the screws to ensure that the locking nuts will repeatedly swing to their locking positions when the panels are secured together. The panels can thus easily be disassembled and reassembled in the field by service personnel.

3 Claims, 3 Drawing Sheets

ESCALATOR SKIRT AND DECK PANEL QUICK RELEASE FASTENER ASSEMBLY

TECHNICAL FIELD

This invention relates to the assembly and disassembly of escalator or the like deck and skirt panels in the field, and more particularly, to a system for simplifying and ensuring proper securement of the deck and skirt panels to each other.

BACKGROUND ART

When escalators and moving walkways are erected in the field, the field installer will drill and tap screw holes in the skirt panels, which holes will match deck panel holes that are predrilled in the factory. Screws are then used to secure the two panels together in overlapping fashion. This procedure is time-consuming, and relies on the gripping power of the tapped holes in the skirt panels. Since these panels are relatively thin, the strength of the connection is undesirably weak, and the likelihood that the threads in the tapped holes will strip is high. Another drawback to the present system relates to the difficulty in reconnecting the panels in the field once they have been disconnected, since realignment of the skirt and deck holes must be achieved to reattach the two panels together.

DISCLOSURE OF THE INVENTION

This invention relates to an improved escalator or the like skirt panel-deck panel connecting system which is created at the manufacturing site, and which can be easily and quickly assembled and disassembled in the field.

The deck panel and the skirt panel overlap each other in a conventional manner, and screw holes are formed in the deck panel, which is preferably the outermost of the two panels. Laterally elongated slots are formed in the skirt panel so as to allow flexibility in aligning the fastening holes when the escalator is assembled. In the factory, screws are positioned in the screw holes and are provided with quarter turn lock nuts which are sized so as to be able to pass through the skirt slots in one orientation, and lock onto the back of the skirts when turned 90° from that one orientation. Stops are provided on the ends of the screw threads which limit the extent that the screws can be turned to loosen the nuts and move them away from the skirt panels. The stops ensure that when the nuts are loosened to the extent that they engage the stop, the nuts can be oriented so as to pass through the slots to allow separation of the panels. At the same time, the stops prevent the nut from backing off so far that they will not reengage the skirt when the skirt and deck are reattached. Thus, the stops ensure proper positioning of the locking nuts at all times.

It is therefore an object of this invention to provide an escalator skirt-deck assembly that can be quickly and easily assembled, disassembled, and reassembled in the field.

It is a further object of this invention to provide a skirt-deck assembly of the character described that is completely constructed at the factory.

It is an additional object of this invention to provide a skirt-deck assembly of the character described which assures a highly secure skirt-deck joint which cannot degrade from repetitive disassembly and reassembly.

These and other objects and advantages of the invention will become more readily apparent from the following detailed description of a preferred embodiment of the invention when taken in conjunction with the accompanying drawings, in which:

BRIEF DESCRIPTION OF THE DRAWINGS

FIG. 2 is a fragmented exploded perspective view of the skirt and deck components of the escalator or the like;

BEST MODE FOR CARRYING OUT THE INVENTION

Figure 1:
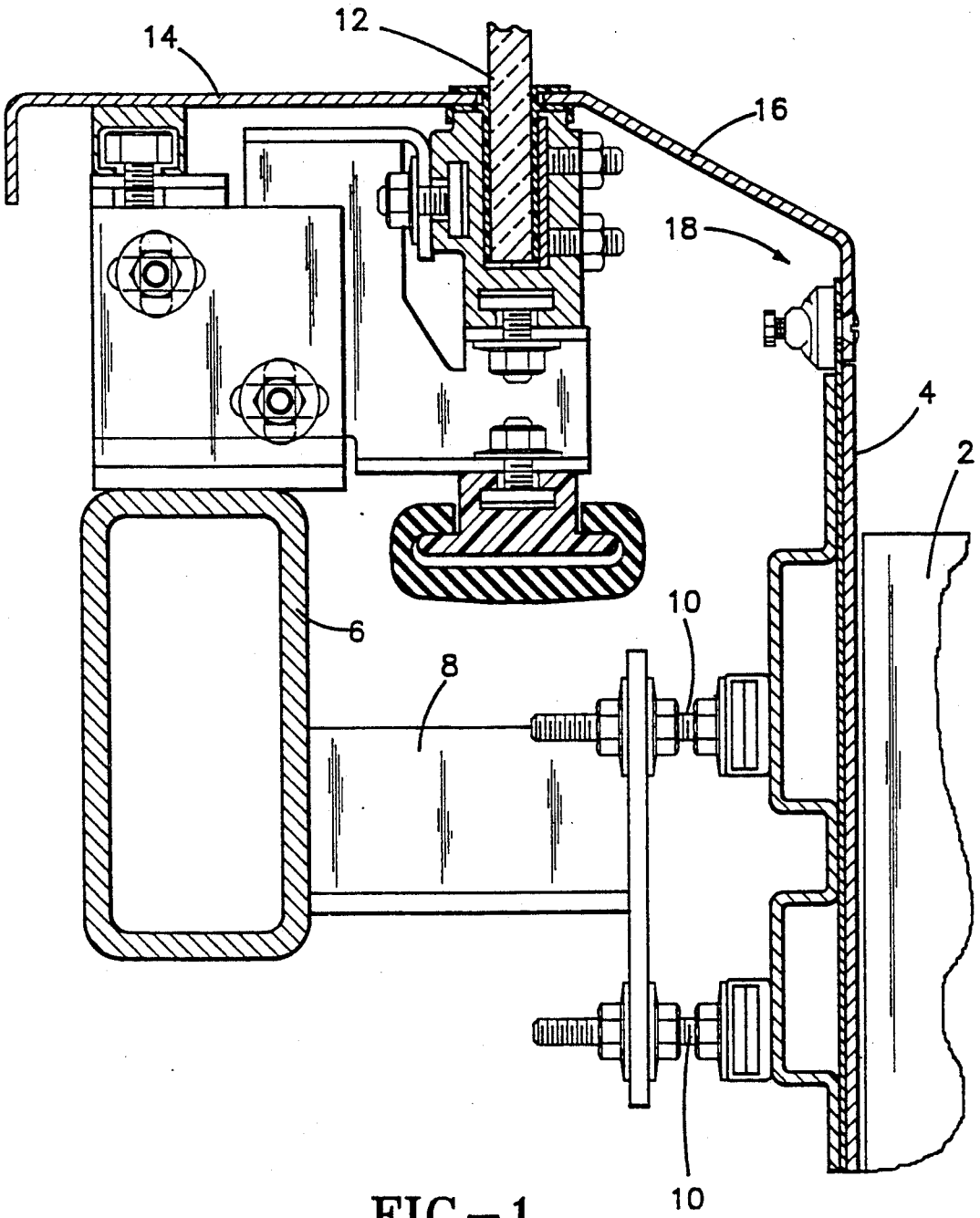
FIG. 1 is a fragmented somewhat schematic sectional view of the skirt-deck area of an escalator or moving walkway.

Referring now to the drawings, there is shown in FIG. 1 the skirt-deck area of an escalator. The escalator steps are denoted generally by the numeral 2 and are flanked by the skirt panels 4. The skirt panels 4 are mounted on the escalator truss 6 by means of a bracket 8 and a pair of jack bolts 10. The balustrade 12 is mounted on a mount assembly which is also secured to the truss. An outer deck panel 14 is secured to the balustrade mount assembly, and the inner deck panel 16 extends from the balustrade mount assembly to the skirt panel 4 and is secured to the latter by a plurality of spaced apart releasable securement assemblies denoted generally by the numeral 18.

Figure 2:
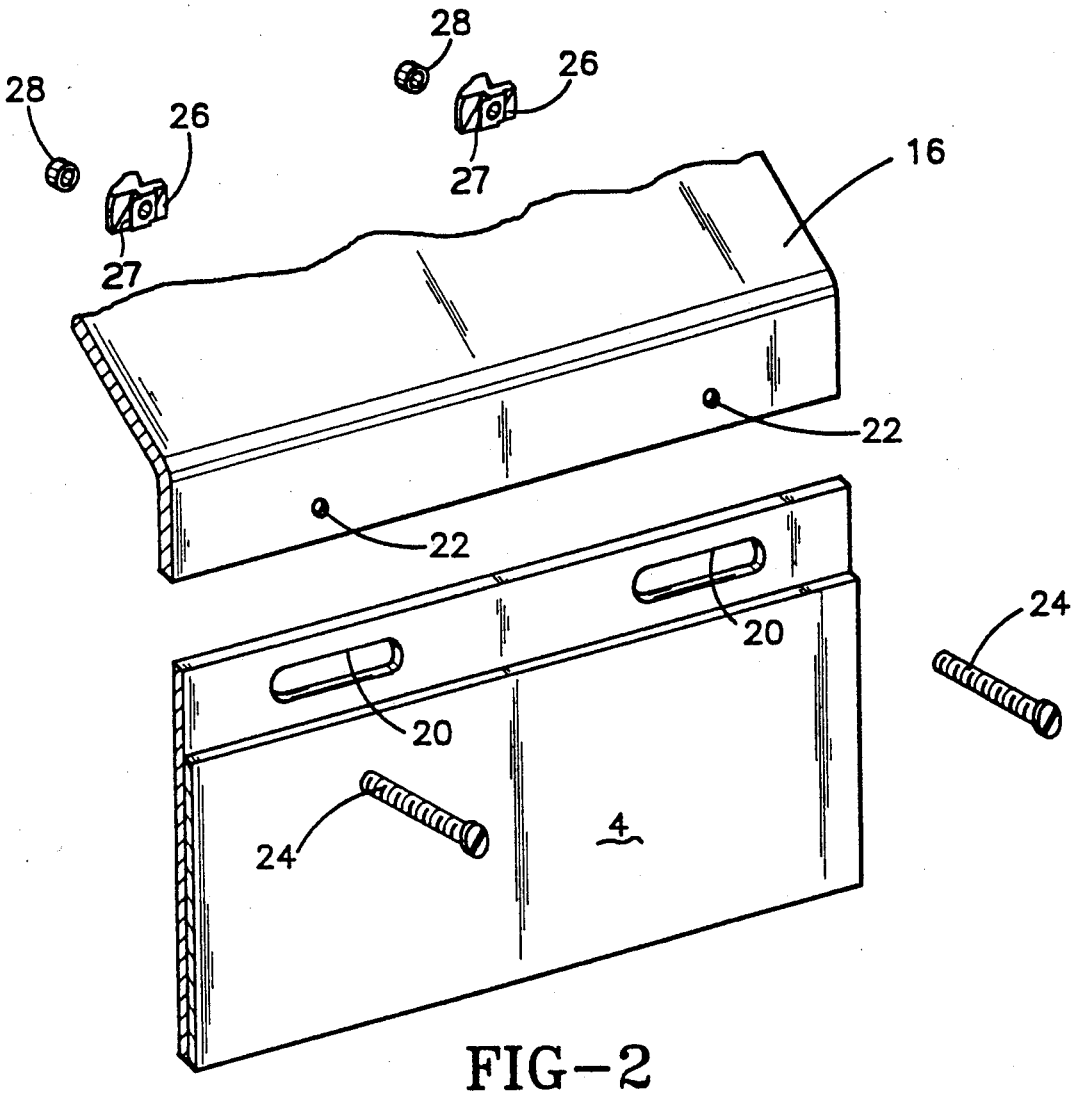
Figure 4:
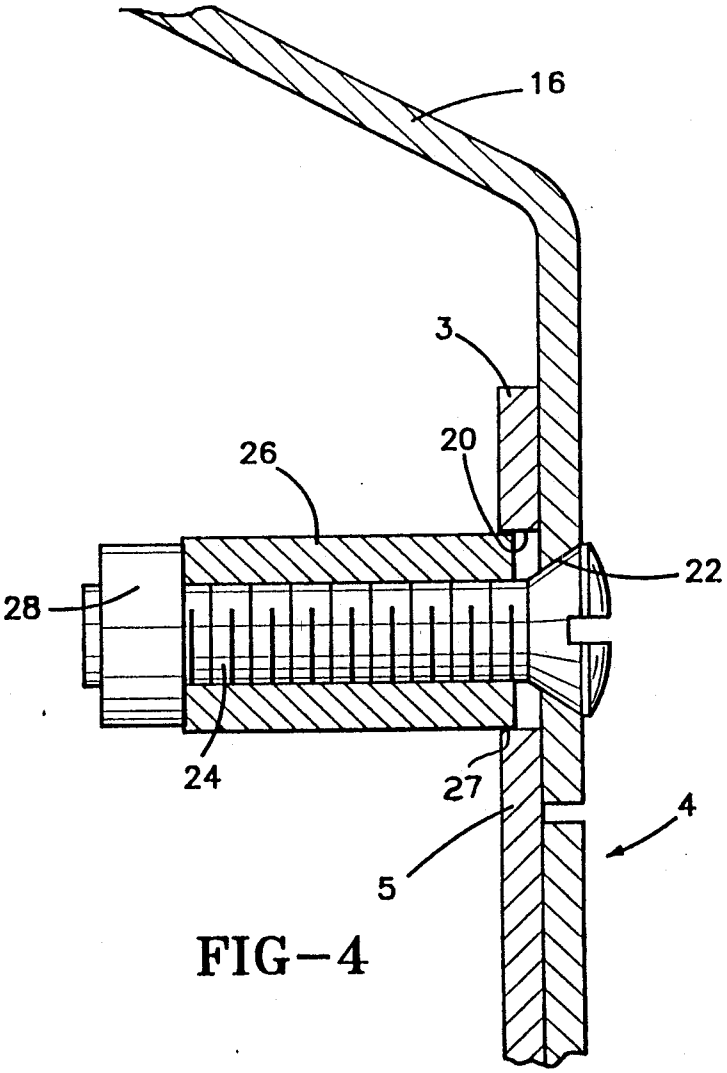
FIG. 4 is a view similar to FIG. 3 but showing the fastener assembly in its release orientation.
Figure 3:
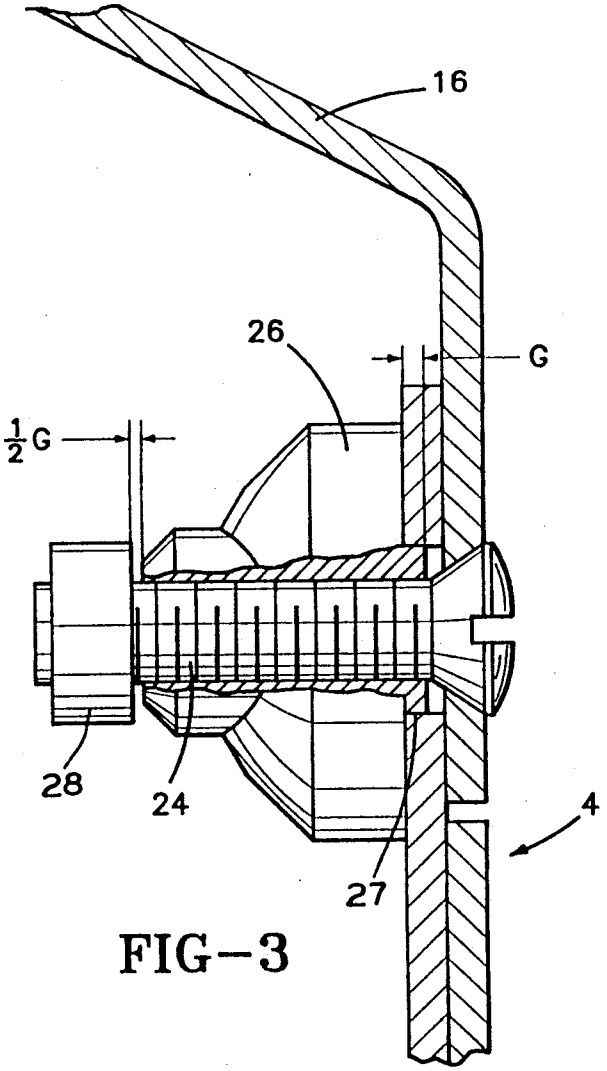
FIG. 3 is a fragmented sectional view of the fastener assembly which secures the deck plate and the skirt plate together.

FIGS. 2–4 show details of the securement assemblies 18. As shown in FIG. 2, the skirt panel 4 has a series of elongated slots 20 formed therein when the panel 4 is manufactured. The deck panel 16 has a like series of round holes 22 formed therein which are also formed when the panel 16 is manufactured. Screws 24 are positioned in the holes 22 in the factory and quarter turn locking nuts 26 are threaded onto the screws 24. The locking nuts 26 are provided with camming bosses 27. Stops 28 are then fixed to the screws 24 so as to limit the extent of loosening movement that the nuts can travel on the screws 24. The locking nuts 26 that are preferred for use with this invention are specifically configured nuts that are sold by Paneloc Corporation of Farmington, Conn. under the trademark VERSALOC. The deck panels 16 leave the factory with the securement assemblies 18 mounted in the holes 22, and during disassembly, the assemblies 18 stay on the deck panel 16.

When the nuts 26 are aligned relative to the slots 20 as shown in FIGS. 2 and 4, the nuts 26 can freely pass through the slots 20. To initially secure the deck 16 to the skirt 4, the nuts 26 are backed off until they abut the stops 28, as shown in FIG. 4, and then the screw 24, nut 26 and stop 28 assembly is inserted through the slots 20. When the head of the screw 24 contacts the wall of the hole 22, and the nut 26 is backed up against the stop 28, as shown in FIG. 4, a portion of the camming boss 27 resides in the slot 20 so that when the screw 24 is turned in the hole 22, the nut 26 will rotate to the locking position shown in FIG. 3. When the nut 26 is in the locking position shown in FIG. 3, the camming boss 27 will extend into the slot 20 a distance G and the space between the nut 26 and the stop 28 is approximately ½ G. This ensures that when the nut 26 is backed off against the stop 28, the camming boss 27 will always project into the slot 20. Thus the nut 26 will never simply rotate with the screw 24 when the assembly is tightened. The distance G is calculated so that the nut 26 turns through a 90° angle when the screw 24 is tightened.

By using the stop mounted on the screws, all guesswork on the part of the field assembler and field mechanic is eliminated. When the panels are disconnected, the mechanic simply turns each screw 24 until contact between the nut 26 and stop 28 is felt, at which time the nuts can be moved into alignment with the slots, and the panels can then be separated. Upon reassembly, tightening of the screws will always result in the nuts returning to this 90° locking position.

Since many changes and variations of the disclosed embodiment of the invention may be made without departing from the inventive concept, it is not intended to limit the invention otherwise than as required by the appended claims.

What is claimed is:

1. An escalator skirt and inner deck panel assembly comprising:

(a) skirt panels flanking steps on the escalator;

(b) inner deck panels extending from balustrade components of the escalator to form overlapping joints with said skirt panels, said joints including inner panel parts proximal to the steps and outer panel parts distal of the steps;

(c) a plurality of spaced apart elongated openings formed in said outer panel parts along substantially the entire length thereof;

(d) a plurality of fastener assemblies for securing said overlapping joints, each fastener assembly including a nut and a companion screw, said fastener assemblies being mounted on said inner panel parts, there being one fastener assembly aligned with each of said elongated openings in said overlapping joints, said nuts being movable between a first position wherein said nuts can pass freely through said openings to allow disassembly of said overlapping joints, and a second position angularly offset from said first position wherein said nuts engage said outermost panel assemblies to secure said overlapping joints; and (e) stop means on each of said screws, which stop means allow limited axial movement of each nut along its companion screw, while preventing the nuts from being removed from the screws, whereby the fastener assemblies remain attached to said inner panel parts when the overlapping joints are disassembled.

2. The assembly of claim 1 wherein said nuts include camming bosses which extend into said elongated openings to ensure proper operation of said fastener assemblies.

3. The assembly of claim 2 wherein said camming bosses extend into said elongated openings a distance G when said assemblies are tightened to secure the panels together, and said nuts are spaced apart from said stop means by a maximum distance which is a fraction of G to ensure that said camming bosses remain in said elongated openings when said fastener assemblies are loosened.

* * * * *